US005338417A

United States Patent [19]

Brücken et al.

[11] Patent Number: 5,338,417

[45] Date of Patent: Aug. 16, 1994

[54] CATHODIC CORROSION PROTECTION FOR AN ALUMINUM-CONTAINING SUBSTRATE

[75] Inventors: Volker Brücken, Konigsstein; Werner Huppatz, Bonn, both of Fed. Rep. of Germany

[73] Assignee: Vereinigte Aluminium-Werke Aktiengesellschaft, Bonn, Fed. Rep. of Germany

[21] Appl. No.: 741,934

[22] Filed: Aug. 8, 1991

[30] Foreign Application Priority Data

Aug. 8, 1990 [DE] Fed. Rep. of Germany ..... 4025088

[51] Int. Cl.[5] ..... C23F 13/00

[52] U.S. Cl. ..... 204/147; 204/196

[58] Field of Search ..... 204/147, 148, 196, 197

[56] References Cited

U.S. PATENT DOCUMENTS

| | | | |
|---|---|---|---|
| 3,142,631 | 7/1964 | Woodley | 204/196 |
| 3,242,064 | 3/1966 | Byrne | 204/196 |
| 3,634,222 | 1/1972 | Stephens | 204/196 |
| 4,080,272 | 3/1978 | Ferry et al. | 204/196 |
| 4,528,460 | 7/1985 | Staerzl | 204/196 |
| 4,713,158 | 12/1987 | Lambert | 204/196 |
| 4,841,988 | 10/1974 | Gleason | 204/196 |

FOREIGN PATENT DOCUMENTS

| | | |
|---|---|---|
| 2092143 | 5/1971 | France . |
| 859096 | 1/1961 | United Kingdom . |
| 2132226 | 7/1984 | United Kingdom . |

*Primary Examiner*—T. Tung

*Attorney, Agent, or Firm*—Darby & Darby

[57] ABSTRACT

Cathodic corrosion protection for surfaces of metallic substrates is provided by carrying out electrolysis, switching off the electrolysis, observing a control voltage and switching on the electrolysis again when the control voltage equals a specified critical voltage. A counterelectrode, which does not corrode significantly by an electrolyte, is provided as an anode. A surface of a substrate services as a cathode. A reference electrode provides a constant electrochemical potential relative to the electrolyte. A potentiostat brings about the electrolysis in the electrolyte. A controller switches on and off the electrolyzing voltage based on a value of the control voltage relative to the specified critical voltage.

10 Claims, 3 Drawing Sheets

CATHODIC CORROSION PROTECTION FOR AN ALUMINUM-CONTAINING SUBSTRATE

BACKGROUND OF THE INVENTION

1. Field of Invention

The invention relates to an apparatus and a method of achieving cathodic corrosion protection for a surface of a metallic, aluminum-containing substrate, particularly a substrate of aluminum or an aluminum-based alloy, which can be flushed by an electrolyte.

2. Discussion of Related Art

The service life of objects which are made of metallic materials is limited because all metals react with materials from their surroundings, with the exception of a few, expensive noble or precious metals, whose usability is limited. As a result, metals degrade, which leads to aging and to a complete loss of function of any object that may have been manufactured from them. Such degradation and aging, which on the basis of chemical reactions lead to the disintegration of the manufactured object, are processes considered to be types of "corrosion".

A frequently observed corrosion is the so-called electrochemical corrosion, which always occurs when two different metals, which are connected electrically with one another, are flushed by the same electrolyte; such a combination of two metals with an electrolyte represents a short-circuited galvanic element, where one of the metals functions as an anode and the other as a cathode. The anode is corroded by the electrochemical In this process initiated by the additional electrolytes manner, the anode is attacked from the surface and dissolved, Under some circumstances, this electrochemical process can also be exploited for the purpose of protecting against corrosion.

For example, if a metal is found which functions as anode when dipped in the same electrolyte as a different metal which is to be protected against corrosion, the metal to be protected will be so protected when brought into electrical conducting connection with the metal functioning as the anode. This concept is used in practice for the protection of iron against corrosion by seawater, in which the iron is connected with a "sacrificial anode" of zinc.

If it is not possible to select such a material or if such a selection must be rejected for reasons of protecting the environment (heavy metal ions are formed by the process described!), the electrochemical process can also be forced. This is done by introducing a power source instead of a short circuit connection between the two electrodes in the electrolyte, one electrode being the substrate to be protected and the other electrode being a corrosion-resistant counterelectrode. The substrate to be protected is connected as the cathode and the corrosion process can usually, in fact, be stopped or at least retarded significantly by selecting a suitable electric voltage.

Electrochemical corrosion protection methods are difficult to handle, where the substrate to be protected consists of aluminum or an alloy based on aluminum. In principle, aluminum is relatively a base metal so that corrosion protection with "sacrificial anodes" is more difficult. A method concerning "cathodic corrosion protection", which uses external voltage source, is also not readily usable.

In an oxygen-containing environment, aluminum is soon coated with a relatively impervious layer of oxide.

Admittedly, this layer is very stable physically. However, because of the amphoteric character of aluminum oxide, it is attacked not only by acids, but also by alkalines. This aluminum oxide layer is stable only in an electrolyte, the pH of which lies between about 4.5 and about 8.5. Electrolytes, which are too acidic or too basic, attack the metal. When the usual, cathodic method of protecting against corrosion is used for aluminum or for alloys based on aluminum, the danger of corrosion by alkaline media is, in fact, present. The electrolysis which is required for the cathodic protection against corrosion causes the cathode to be charged with the cations from the electrolyte, which have been reduced by the electrolysis- As a result, an alkaline liquid boundary layer, which under some circumstances can lead to the alkaline corrosion of the aluminum, is formed in the vicinity of the surface of the object which is to be protected.

If an object of an aluminum-containing material is to be protected cathodically against corrosion, the chemical conditions existing at the object must be monitored very carefully so as to exclude the occurrence of alkaline corrosion with certainty. A modification of the method of cathodic protection against corrosion, in which a certain degree of control is given at least for the electrical conditions, is proposed in DE-U 8900911. This publication relates to a cathodic protection of a steel pipe against corrosion. The steel pipe encases a high-tension power line, so that it can be transferred underground. The counterelectrode of the pipe is the ground of a connecting station of the pipe. The pipe is acted upon by a negative voltage relative to ground. In order to observe the relevant protection regulations, the magnitude of the voltage of the pipe against ground must be reliably limited. It may be proposed that this be brought about by a number of diodes, which are connected in antiparallel fashion. However, this is not suitable for monitoring the electrochemical conditions at the cathode because not only the cathode is charged by the electrolysis that takes place between anode and cathode; the cathode is charged with reduced cations from the electrolytes and the anode is charged with oxidized anions. Consequently, because of the electrolysis, the electrochemical potential of both electrodes with respect to the electrolyte is changed. The voltage existing between the electrodes accordingly is not a measure of the conditions at an electrode. Instead, it is a measure of the total changes at the two electrodes and, with that, cannot be called upon for a reliable evaluation of the conditions at a single electrode, be it cathode or anode.

It would be desirable to provide a cathodic corrosion protection method for a surface of a metallic substrate, particularly an aluminum-containing substrate, which faces an electrolyte. With such a method, the electrochemical conditions at the surface, which is to be protected, may be monitored precisely and controlled directly to avoid formation of excessive alkaline boundary layers.

SUMMARY OF THE INVENTION

Pursuant to the invention, an apparatus or arrangement for achieving cathodic protection against corrosion for a surface of a metallic, aluminum-containing substrate, which may be flushed by an electrolyte, is set forth, which preferably has the following components:

a) at least one counterelectrode, which may be flushed by the electrolyte and is not corroded or is corroded to only an insignificant extent by the electrolyte;
b) an associated reference electrode, which may be flushed by the electrolyte and has a constant electrochemical potential relative to the electrolyte;
c) an associated potentiostat, which is connected electrically with the substrate and the counterelectrode and by means of which electrolysis can be brought about in the electrolyte, an electrolyzing voltage being connected between the substrate as cathode and the counterelectrode as anode;
d) an associated controller, which is connected electrically with the substrate, the reference electrode and the potentiostat and by means of which an electrical control voltage between the reference electrode and the substrate can be measured and the electrolyzing voltage switched on and off as well as controlled.

In addition to the protecting electrode, which is provided by the substrate that is to be protected, and the counterelectrode, it is desirable to provide an additional electrode, namely a reference electrode with a constant electrochemical potential relative to the electrolyte. An electrolysis is run between the protecting electrode and the counter electrode over the potentiostat, which has the voltage source. A control voltage is measured between the protecting electrode and the reference electrode. This control voltage corresponds to the difference between the electrochemical potentials of the reference electrode and the protecting electrode and faithfully reflects the electrochemical conditions at the protecting electrode, because the electrochemical potential of the reference electrode is not changed by the electrolysis and the electrochemical potential of the counterelectrode does not contribute anything to the control voltage. Accordingly, by providing the reference electrode, it becomes possible to measure the electrochemical potential of the substrate that is to be protected.

Pursuant to a further embodiment of the invention, the control voltage, which characterizes the electrochemical conditions at the substrate that is to be protected, is used to control the electrolysis. In this connection, the electrolysis may be switched on and off and it is possible to effect the electrolysis itself, for example, by controlling the electrolyzing voltage.

In accordance with the invention, counterelectrodes are suitable that have a surface layer which may be flushed by the electrolyte, but cannot be attacked by the electrolyte and is not dissolved by the electrolysis. Particularly suitable for the surface layer are noble metals, particularly platinum, platinum-coated titanium, nickel, or other metals or electron conductors, which will become hardly corroded if at all, as well as carbon.

One possibility for controlling the electrolysis within the scope of the invention is to control the electrolyzing voltage. This control is done so that the control voltage, which is measured during the electrolysis, is equal to a first critical voltage, which can be specified in the controller.

In the course of the electrolysis, the electrochemical potential of the substrate to be protected adjusts itself according to the electrolyzing voltage specified. It is advisable to select the electrolyzing voltage in such a manner that the electrochemical potential of the substrate to be protected does not become too negative. In this manner, the formation of strongly alkaline boundary layers is excluded with certainty.

A low-cost and easily realizable possibility for effecting this control of the electrolysis is to provide the potentiostat with an operational amplifier that has an inverting input, a noninverting input, an output and a ground connection. The substrate is connected with the ground connection. The reference electrode is connected with the inverting input and the counter electrode is connected with the output. Furthermore, the first critical voltage is applied between the ground connection and the noninverting input. When so connected, the operational amplifier generally adjusts the electrolyzing voltage so that the controlling voltage becomes practically identical with the first critical voltage. Naturally, the operational amplifier need not be the only active element of the potentiostat, but may, of course, be provided with additional elements, such as voltage trackers and power amplifiers.

A further method of control, which can be used to advantage in accordance with the invention, is, notwithstanding other developments of the invention, characterized by a second controller, for which a second critical voltage can be specified. In this connection, the initially switched off electrolyzing voltage is switched on when the control voltage becomes equal to the second critical voltage.

This further method of control corresponds to switching on the electrolysis when the electrochemical potential of the substrate to be protected becomes equal to a critical potential. This critical potential advantageously is the highest potential which the substrate to be protected may assume without the occurrence of anodic corrosion. This value, as well as the value of the first critical voltage, must be selected to correspond to the material of the substrate. Such an arrangement works with a temporally pulsating electrolysis.

If the electrochemical potential of the substrate to be protected is shifted too much in the direction of positive values, the electrolysis is switched on, whereupon the electrochemical potential becomes more negative once again.

After a certain period of time in which polarization is sufficient with a cathodic protection potential, the electrolysis is switched off and the controller once more monitors the control voltage. If the polarization is insufficient, the controller switches the electrolysis on once again.

To complete the control of the electrolysis, the controller is constructed so that the duration of the electrolysis can be specified for it and the electrolysis in each case is carried out for a time interval, the duration of which is equal to the electrolyzing duration. With this, the changes, which are to be brought about by the electrolysis on the surface that is to be protected, can be characterized precisely and the alkalinity of the boundary layer at the surface remains limited.

A further object of the invention is a method for operating the inventive apparatus or arrangement, the following steps being carried out recursively:
a) carrying out the electrolysis for a specified time period, then switching off the electrolysis;
b) observing the control voltage and switching on the electrolysis as the control voltage becomes equal to a specified, second critical voltage.

Aside from the advantages already mentioned, this method, which finally leads to a pulsating electrolysis to bring about the cathodic protection against corrosion, also has the advantage of requiring significantly less energy than a continuous electrolysis. The electrolysis is carried out only when it is actually required. The expenditure of energy is correspondingly limited to those cases for which it is actually necessary. Of course, controller and potentiostat also require a certain amount of energy. However, this expenditure of energy may be kept at a practically negligible level by conventional, commercial, extremely energy-saving components (CMOS logic).

As already mentioned, the control of the electrolyzing voltage during the electrolysis is appropriate if carried out in such a manner that the control voltage is equal to a specified first critical voltage, or that the electrochemical potential existing during the electrolysis at the cathode remains limited in the negative direction at an appropriate critical value. This critical value and the first critical voltage are to be selected in accordance with the substrate and the electrolyte. This limitation prevents the formation of too thick an alkaline boundary layer and, therefore, eliminates the danger of alkaline corrosion in a reliable manner.

In a particularly advantageous further embodiment of the inventive method, a duration for the control time and for a third critical voltage, which lies between the first critical voltage and the second critical voltage, are also additionally specified for monitoring the control voltage with the electrolysis switched off. The electrolysis is switched on again immediately after the expiration of the control time, which is switched off in the event that the control voltage becomes equal to the third critical voltage.

Within the scope of this further embodiment, there is, in addition to the observation of the height of the control voltage, an observation of its development as a function of time. The electrolysis is also switched on again in the event that the control voltage shows a certain temporal change, which exceeds a specified time interval of a switching off duration. This takes place even though the control voltage has not yet reached the second critical voltage. The certain temporal change arises when it is possible to exert only a slight effect on the surface to be protected by an electrolysis cycle, as when the surface is covered with a corrosive material such as $Ci^-$ and the pitting potential is quickly reached.

The reliability of the method is improved further by this additional switching-on criterion. The modification implements, to some extent, a PD controller for switching the potentiostat. The PD controller is a proportional and differential/derivative regulator which controls the least amount of electrical breakdown quickly.

BRIEF DESCRIPTION OF THE DRAWINGS

For a better understanding of the present invention, reference is made to the following description and accompanying drawings while the scope of the invention is set forth in the appended claims.

DESCRIPTION OF THE PREFERRED EMBODIMENT

Figure 1:
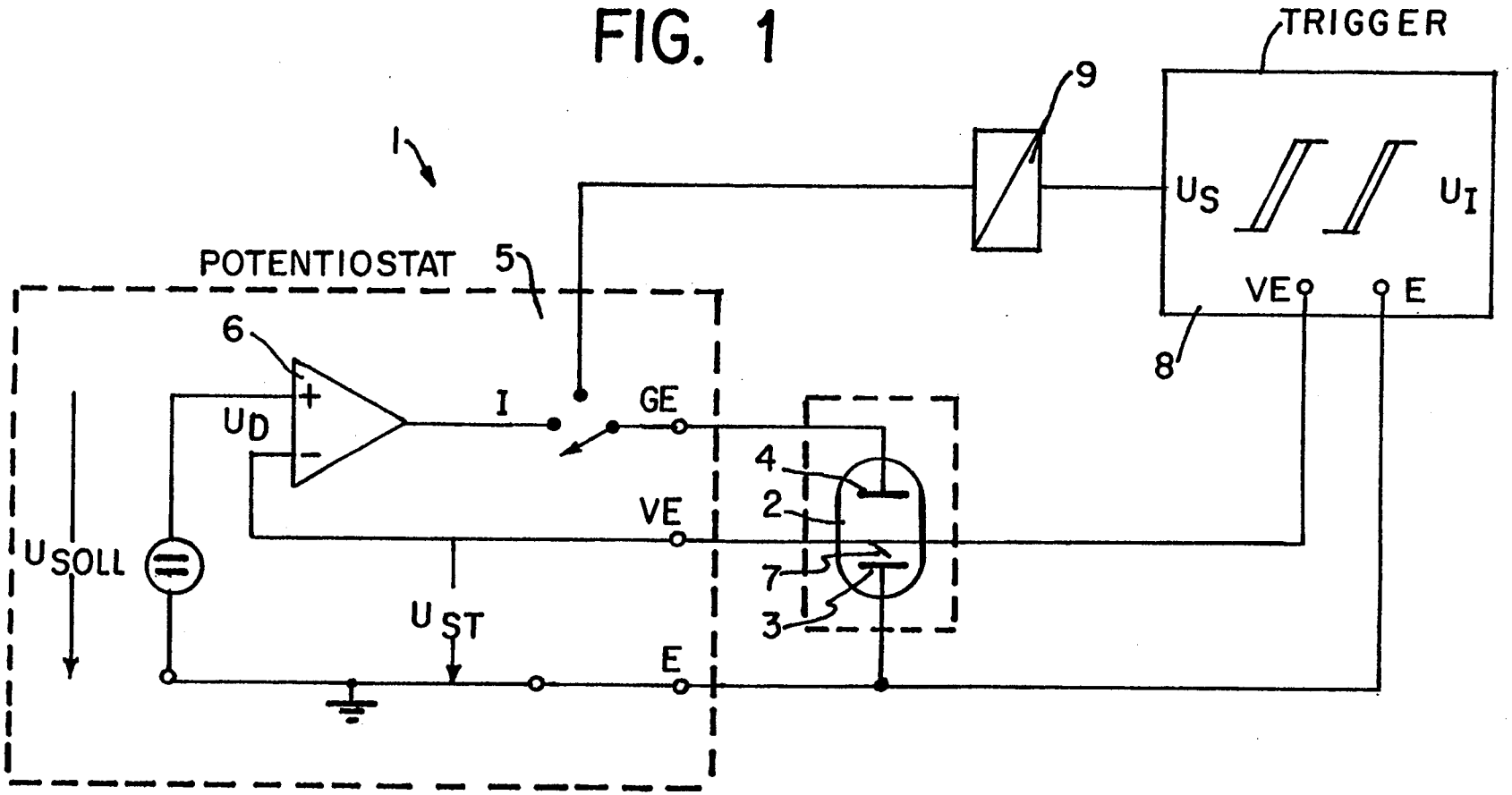
FIGS. 1 and 1A show a block circuit diagram of an arrangement or apparatus for achieving cathodic corrosion protection for the substrate. The substrate preferably consists of a metallic aluminum alloy and has a surface which is flushed by an electrolyte. The substrate functions as a cathode, as opposed to an anode, in the electrolysis. A counterelectrode functions as the anode.

FIG. 1 shows a block circuit diagram of the arrangement or apparatus 1 for achieving cathodic protection against corrosion. A galvanic element 2 is indicated in the center. In this galvanic element 2, the aluminum substrate 3 is disposed, which is to be protected against corrosion and consists of an AlMgSi 1-alloy. The surface of the aluminum substrate is flushed by electrolyte of the galvanic element. The galvanic element has an electrolyte which may be a watery KCL solution or any type of water, such as drinking water, tap water or brackish water.

To carry out the cathodic protection against corrosion, an electrolysis is carried out between this aluminum substrate 3 and a counterelectrode 4, which is disposed at some distance from it, such as $>1$ mm. In this electrolysis, the aluminum substrate 3 is the cathode and the counterelectrode 4 the anode.

The surface of the aluminum substrate to be protected is made of aluminum, which has a strongly negative character, and continues to be exposed to the corroding electrolyte. The aluminum substrate may be a solid semifinished form such as foil, sheet metal, plate, molded form be a coating, e.g. by aluminizing or alitizing of aluminum on steel.

Figure 2:
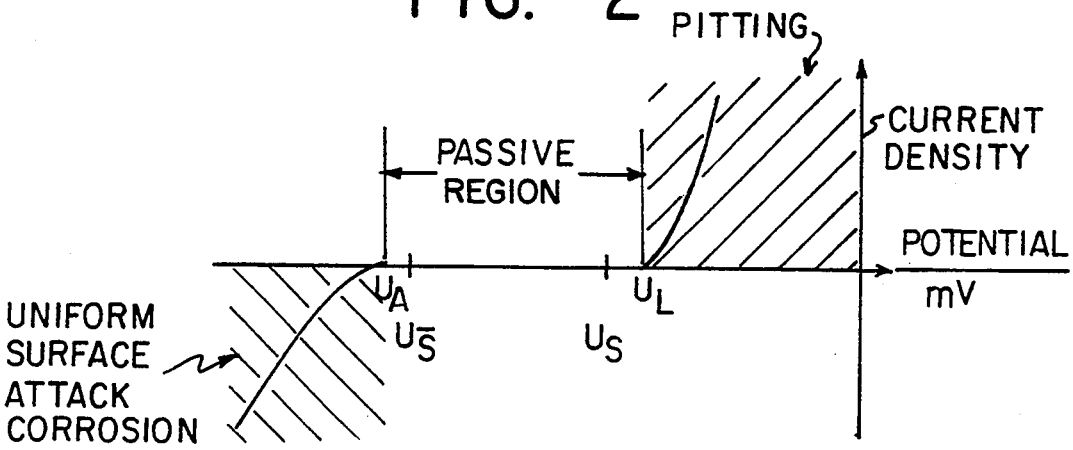
FIG. 2 shows the current density as a function of the potential for the substrate during an electrolysis; the "passive region" is shown, in which corrosion does not occur, as well as the regions in the anodic direction and in the cathodic direction, where pitting or uniform surface attack of the aluminum occurs with formation of aluminate.

Since the electrons are supplied to the aluminum substrate as a cathode during the electrolysis, the potential of its metal surface is shifted in the cathodic direction and the rate of the corrosion that occurs is reduced to such an extent that there is practically no longer any erosion of aluminum. However, for the aqueous electrolyte, this is so only at a pH ranging from 4.5 to 8.5, at which the solubility of the aluminum oxide layer is low and if, as shown in FIG. 2, the polarization potential that arises at the surface of the aluminum substrate lies in the "protection potential region" (passive region). Consequently, there is neither pitting nor uniform surface attack, which results from the formation of alkaline liquid boundary layers.

Pitting arises on aluminum from the influence of acids and alkalines. It may be observed in neutral water containing chloride (e.g., seawater) and arises only in isolated and localized corrosion areas of the aluminum. Pitting takes place if the threshold potential for pitting at the anodic side is exceeded. In contrast, uniform surface attack arises if the critical potential at the cathodic side is passed and results in uniform thickness loss.

The potentiostat 5, which is connected electrically with the aluminum substrate 3 and the counterelectrode 4, is shown in the left part of FIG. 1. The necessary electrolyzing voltage, which can be controlled further and also switched off by means of an operational amplifier 6, is switched on by means of the potentiostat 5.

The counterelectrode 4 is formed from a material which is not corroded by the electrolyte because of the cathodic corrosion protection. The counterelectrode is preferably made of a noble or precious metal such as platinum, titanium, nickel, tantalum, or oxides thereof or any mixture thereof. Gold or silver may be used instead. The counter electrode may either be completely made of such noble metals or be galvanized or plated with it, e.g., precipitated nickel on steel.

The potentiostat can be switched on and off by a controller in the form of a trigger. In this manner, the potentiostatic pulses can be controlled with respect to their height and, in this respect, a suitable, brief, cathodic polarization of the substrate is achievable by briefly lowering the potential.

The aluminum substrate is maintained by the electrolysis at a constant cathodic potential within the protective potential range. During a certain switching-off time of the electrolysis, a "control voltage", which is a direct measure of the redox potential on the surface of the aluminum substrate in the electrolyte, is now measured between a reference electrode 7, which is flushed by the electrolyte and has a constant electrochemical potential with respect to this, and the aluminum substrate 3.

After the electrolysis is switched off after a certain period of electrolysis has elapsed, the control voltage is now observed and supplied to the controller for the electrolyzing voltage. With this, the redox potential or the polarization potential of the aluminum substrate are controlled.

The controller consists of an operational amplifier 6 and a window discriminator 8 and a timer 9 for switching the potentiostat 5 on and off. The window discriminator 8 is exemplified by model TCA 965 as manufactured by Siemens. The timer 9 is exemplified by model NE 555 as manufactured by NEC. The first, second and third critical voltages may be set into the controller for effecting regulation of the switching on and off of the electrolyzing to avoid corrosion. Operation is then automatic without the need for operator monitoring or intervention.

Within the potentiostat 5, FIG. 1 identifies the set point of polarization potential ($U_{So11}$), the actual potential ($U_{1st}$) measured by the reference electrode 7, the potential difference ($U_D$) between $U_{So11}$ and $U_{1st}$, current (I) and node connections to the counter electrode (GE), reference electrode (VE) and the electrode (E) which is the aluminum substrate 3. The differential voltage ($U_D$) may be considered as a breakdown potential which is indicative of the pitting potential $U_L$ of FIG. 2.

Within the window discriminator 8, FIG. 1 also shows nodes for connection to the reference electrode (VE) and electrode (E) which is the aluminum substrate. Also shown are triggers for the protection potentials ($U_S$) and ($U_I$). The first, second and third critical potentials ($U_s$), ($U'_s$) and ($U_I$) may be set as values into the window discriminator 8, which receives the measured potential from the two half cells, i.e., from the reference electrode 7 and the working electrode or aluminum substrate 3. Based on this, a determination is made as to which set values are exceeded or still fall below the measured potential.

The potentiostat is switched on and off by the voltage states available at the output of the window discriminator 8. For this purpose, the timer 9 is connected in series. When the protective potential falls below the necessary negative value, the timer 9 (multivibrator) supplies an output signal, which, as such, sets in operation an "astable multivibrator". With this, the desired duration of the polarization ($t_p$) and the duration of the switching-off process ($t_a$) of the electrolysis may be set.

After a certain length of switch-off time, the electrolysis is switched on again by the controller when the control voltage is equal to a specified critical voltage $U'_s$ at the anodic boundary of the protective potential range. By these means, a constant, cathodic potential is once again applied to the aluminum substrate, so that the redox potential once again lies at the lower cathodic limit of the protective potential range.

The lowered "cathodic potential" is produced by potential-controlled, cathodic voltage pulses, which polarize the surface of the aluminum in regions, in which the "passive behavior" of aluminum according to the protective potential region exists for as long as possible. This lower, negative critical voltage $U'_s$ (first critical voltage) may be specified for the operational amplifier 6 (see FIGS. 2 and 3). During the electrolysis, the electrolyzing voltage can be controlled in such a manner that the control voltage between the reference electrode 7 and the aluminum substrate 3 becomes equal to this first critical voltage $U'_s$.

Figure 3:
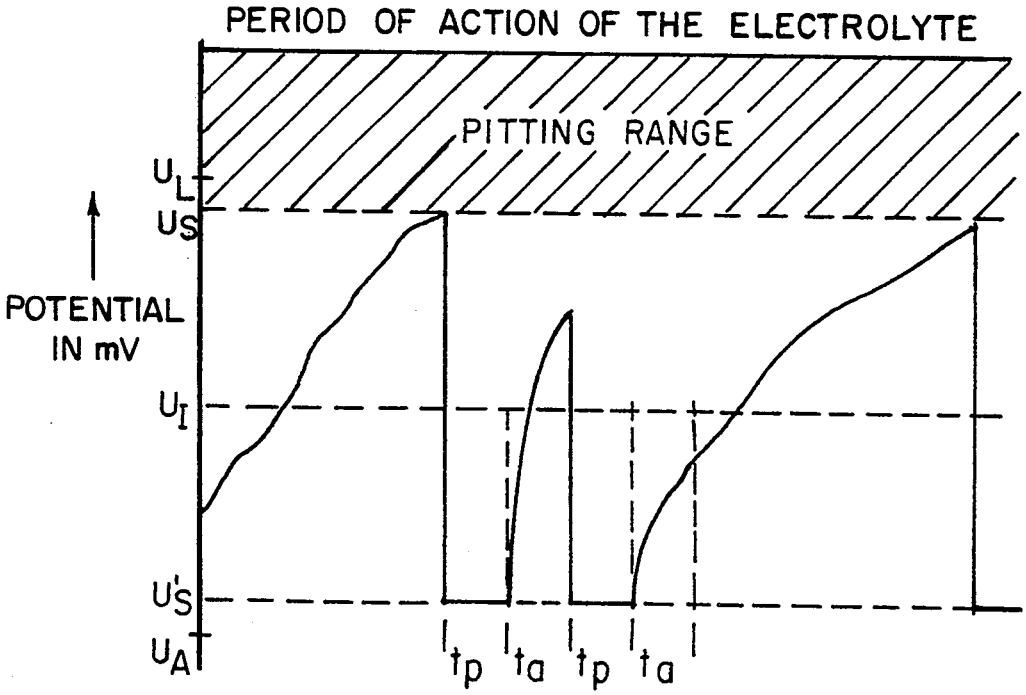
FIG. 3 shows the redox potential of the substrate in the electrolyte as a function of time during active corrosion protection for the aluminum substrate. A sequence of potential-controlled cathodic voltage pulses, which lower the redox potential of the aluminum substrate in the vicinity of the lowest, permissible, negative potential value of the "passive region" are used. For the duration of these pulses, there is a cathodic polarization of the substrate, which will still continue for a certain switching off time of the potentiostat.

As shown in the curve of the potential as a function of time in FIG. 3, the potential-controlled cathodic voltage pulses are always specified for a relatively short time interval of a few seconds to minutes.

The same is true for duration of the electrolysis and of the polarization $t_p$ at the surface of the aluminum substrate. For a certain time interval $t_a$, the lowering of the potential is interrupted by negative voltage pulses and also by the electrolysis itself. This has the advantage that a possible excess cathodic polarization is avoided or at least minimized in the case of an unfavorable geometric arrangement of the substrate. In addition, the protective current required is considerably less than the current required for constant corrosion protection.

Since the lower and upper critical potential ($U'_s$, $U_s$) of the protective potential region are exceeded only after a surface-specific induction period, it is better to polarize the aluminum substrate, which is to be protected, by lowering the cathodic potential "only when required", that is, when the upper critical potential (second critical potential $U_S$) is reached, than to provide a constant, cathodic protection against corrosion The first critical potential U's may be considered a cathodic protection potential and the second critical potential $U_s$ may be considered a pitting protection potential.

With respect to the energy required, this potential-controlled pulse method of protection is less expensive than a constant polarization. Moreover, it is suitable, for example, for use in protecting aluminum materials in the maritime area or in drinking water containers and tanks.

As shown in FIG. 3, the electrolyzing voltage and the cathodic lowering of the voltage are accomplished as a function of the slope of the redox potential curve of the aluminum substrate after the electrolysis is switched off.

Within a certain control time, such as the switching off time period $t_a$ after the electrolysis is switched off, a critical voltage $U_I$, which lies between the first critical voltage $U'_S$ and the second critical voltage $U_S$, may be exceeded by the control voltage. The control voltage becomes more positive in correspondence with the redox potential of the aluminum substrate. Preferably, $U_I$ lies about 100 mV beneath the value of $U_s$ and is not exactly in the middle between $U_s$ and $U'_S$.

If the critical voltage $U_I$ is so exceeded, the electrolysis is switched on again, so that there is then once again a lowering of the cathode voltage and a polarization to the level of the first critical voltage for the duration of the voltage pulse. Therefore, $U_I$ serves as an indicator as to whether polarization was sufficient from the electrolysis. If $U_I$ is exceeded, then the polarization is not sufficient and further polarization is needed by effecting electrolysis again at the first critical value $U'_S$.

On the other hand, if the critical voltage is not yet exceeded during the switching off time $t_a$ by the rising control voltage, the voltage is lowered only when the control voltage has risen to the second critical value $U_S$. A potential indicator is used to determine the slope. In this respect, the potential indicator functions for modelling a PD controller but is not shown in the drawings.

The counterelectrode 4 comprises a noble or precious metal such as platinum or else another metal or other electron conductor which corrodes little if at all. By corroding a "little", it is permissible for the counterelectrode to corrode by an insignificant amount such as ≦0.01 mm/m thickness. This material of the counterelectrode is inert towards the electrolyte.

Figure 1A:
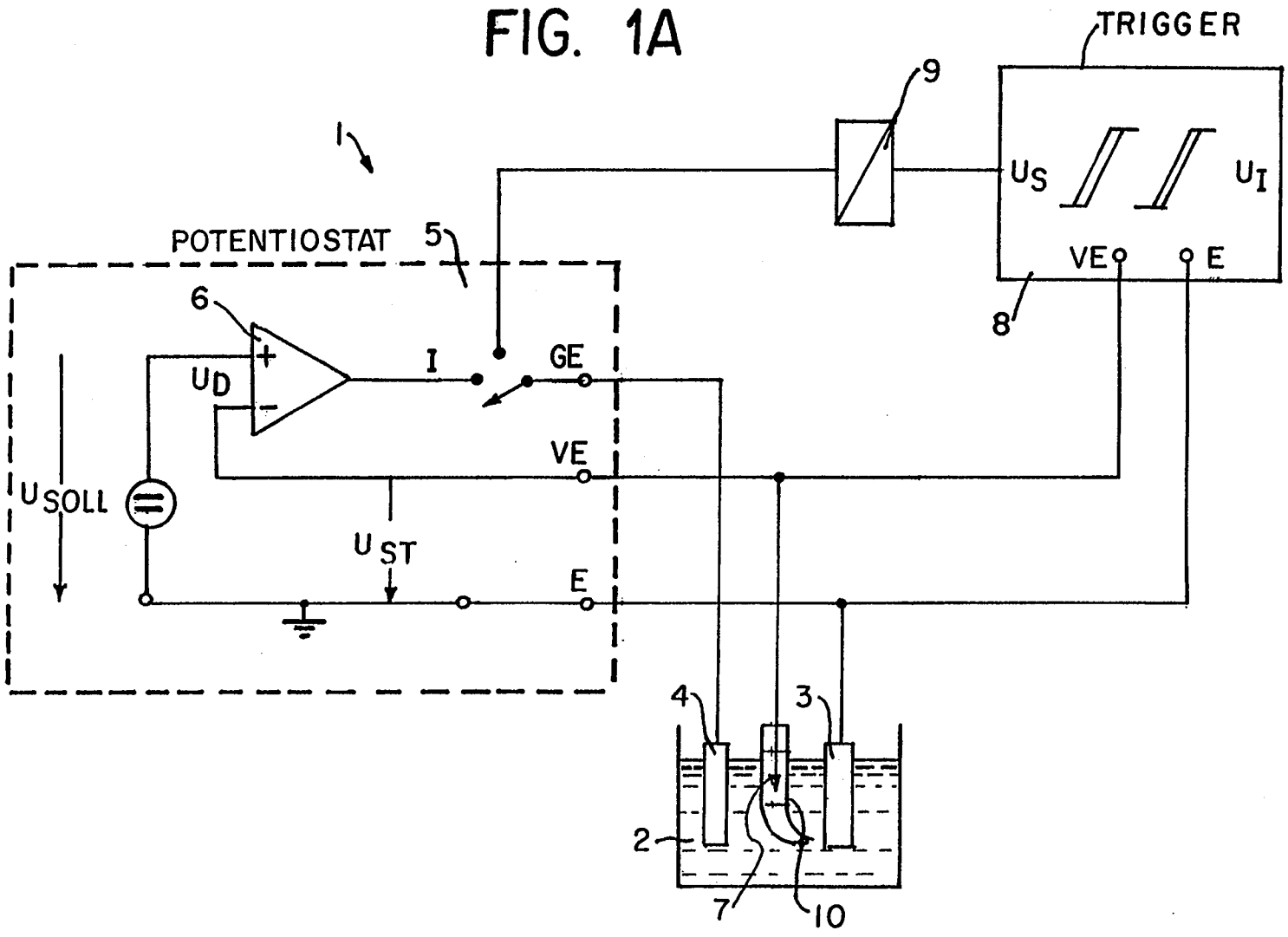

The reference electrode 7, which is disposed in the vicinity of the surface of the aluminum substrate in the electrolyte and has a constant electrochemical potential with respect to the electrolyte, comprises a cylindrical hollow body of glass, organic plastic or a different insulating material and is provided with a curved peak potential sensor 10 (see FIG. 1A). The reference electrode 9 contains a diaphragm which functions to make it possible to tap the potential close to the protecting wall of the aluminum substrate.

The galvanic element 2 may be considered electrochemically to have a first half cell in the form of the reference electrode 7, a second half cell in the form of a working electrode, i.e., the aluminum substrate 3 as the cathode and a counter electrode 4 as the anode. As a reference system for the first half cell, it is possible to use $Hg/Hg_2Cl_2$, Ag/AgCl or suitable noble metals in their aqueous solution or in the solid bed. For example, the three electrodes are in a container or tank containing seawater or top water.

In the protection system of the invention, the reference electrode has the function of sensing the redox potential (corrosion potential) occurring at the wall of the aluminum substrate. Further, the reference electrode supplies this "control voltage" as an electrical voltage signal to the potentiostat 5 for controlling the electrical currents, as well as to the potential indicator, which functions by determining the slope of the potential curve.

During the electrolysis, the reference electrode is almost currentless. A current is flowing in the electrolyte only between the aluminum substrate 3 and the counterelectrode 4. This current is controlled by the operational amplifier 6 in such a way that, as a result of the lowering of the potential of the potentiostat, the applied potential of the current-carrying aluminum substrate 3 (control voltage $U_{ist}$), which is connected in the circuit as a cathode, follows the specified first critical voltage ($U'_S$) and, independently of electrochemical processes, is held constant at its instantaneous value.

The operational amplifier 6 is preferably used as potential-controlling unit of the potentiostat 5, the basic circuit of which is shown in FIG. 1. Because of its high input resistance (F.E.T. input step) of about $10^{14}$ ohms and its low input static current of approximately $30^{-12}$ amperes, the operational amplifier 6 does not put a load on either the reference electrode 7 or the nominal voltage source ($U_{soll}$) Of the potentiostat. Since the operational amplifier delivers a maximum output current of only ±20 mA, a power amplifier is connected in series with the operational amplifier. The power amplifier may produce, for example, a maximum output current related to the aluminum substrate of ±200 mA and more, depending on the electrical requirements.

Further requirements for carrying out an active corrosion protection by means of a potential-controlled cathodic pulse for aluminum parts consist of a) a possible maximum modulation of the counterelectrode 4 to +12 V, the ability to set the first critical potential ($U'_S$) manually at the nominal voltage source at a value from 0 . . . 2,000 mV, c) the ability to set the protective potential $U_S$ (second critical potential) at a value from 0 . . . 2,000 mV d) the ability to set the third critical voltage ($U_I$) of the potential indicator at a value between 0 . . . 2,000 mV and e) the ability to set the time period of the polarization $t_p$ at a value between 1 and 10 minutes and the time period of the switching off time period $t_a$ at a value between 1 minute and 10 minutes.

For setting the three critical voltages $U'_S$, $U_S$ and $U_I$ into the window discriminator 8, FIG. 2 should be available to ascertain the correct values of the critical voltages from the curve. The durations of switching on and off of the electrolysis will follow the curve of FIG. 3. FIGS. 2 and 3 may be plotted for different types of materials and electrolytes- For effective regulation of the electrolysis without corrosion, the values of $U'_S$ and $U_S$ should be about 30-50 mV from the end point corrosion potentials, i.e., the first (lower) critical value $U'_s$ is 30-50 mV above the uniform surface attack potential $U_A$ (below which uniform surface attack may take place) and the second (higher) critical value $U_S$ is 30-50 mV below the pitting potential $U_L$ (above which pitting may take place).

For an aluminum alloy AA 6060 in seawater, $U_A = -1470$ mV SCE. The appropriate value $U_S$, for providing cathodic protection of this aluminum alloy AA 6060 in seawater must be higher than −1420 mV SCE. For AlMgSi −0.5 in seawater, $U_L = -740$ mV SCE. The appropriate value for cathodic protection of corresponding aluminum alloy AA 6060 has to be lower than $U_S = -790$ mV SCE in seawater.

In the case where the substrate is composed of AlMgSi-1 and is in an electrolyte of seawater, $U_S = -780$ mV SCE, $U'_S = -1300$ mV SCE, $U_I = -900$ mV SCE and $U_L = -750$ mV SCE where SCE is a standard related to a saturated calomel electrode.

While the foregoing description and drawings represent the preferred embodiments of the present invention, it will be understood that various changes and modifications may be made without departing from the spirit and scope of the present invention.

What is claimed is:

1. An apparatus for achieving cathodic protection against corrosion for a surface of a metallic aluminum-containing substrate, which is flushed by an electrolyte, the apparatus comprising:

a) at least one counterelectrode, which is flushed by the electrolyte and is at most corroded to only an insignificant extent by the electrolyte;

b) at least one associated reference electrode, which is flushed by the electrolyte and has a constant electrochemical potential relative to the electrolyte;

c) an associated potentiostat, which is connected electrically with the substrate and the counter-electrode for bringing about electrolysis in the electrolyte with an electrolyzing voltage being connected between the substrate, as cathode, and the counter-electrode, as anode; and d) an associated controller, which is connected electrically with the substrate, the reference electrode and the potentiostat, for responding to a measurement of an electrical control voltage which corresponds to a difference between the electrochemical potential of the reference electrode and the electrochemical potential of the substrate to switch on and off the electrolyzing voltage, e) said associated controller directed said electrolysis to switch on until the electrochemical potential of said substrate (i) reaches a potential which is closer to a uniform surface attack potential than to a pitting potential and higher than the uniform surface attack potential and (ii) polarizes said substrate, whereby said uniform surface attack potential causes a uniform attack on a thickness of said substrate and said pitting potential causes pitting of said substrate, and f) said associated controller including means for determining a redox potential curve of the substrate when said electrolysis is switched off based on said measured control voltage and for effecting regulation of said electrolysis in response to said determination.

2. The apparatus of claim 1, wherein the counter electrode has a surface, which is flushed by the electrolyte and comprises an electron conductor.

3. The apparatus of claim 1, further comprising means for specifying a first critical voltage for the controller for enabling said controller to control the electrolyzing voltage during the electrolysis in such a manner that the electrical control voltage becomes equal to the first critical voltage, which corresponds to the potential which is closer to a uniform surface attack potential than to a pitting potential.

4. The apparatus of claim 3, wherein the potentiostat has an operational amplifier with an inverting input, a noninverting input, and an output, said potentiostat including a ground connection in electrical connection with the noninverting input and the substrate, the reference electrode being connected to the inverting input, and the counter electrode being connected to the output; and said potentiostat further comprising means for applying the first critical voltage between the ground connection and the noninverting input.

5. The apparatus of claim 4, wherein the operational amplifier has an input resistance and an input current, so as to avoid placing a load on the reference electrode and to avoid placing a load on a nominal voltage source of the potentiostat.

6. The apparatus of claim 1, further comprising means for specifying a second critical voltage for the controller so that the electrolyzing voltage is switched on when the controlling voltage is equal to the second critical voltage, the second critical voltage being indicative of a potential which is closer to the pitting potential than to the uniform surface attack potential.

7. An apparatus as in claim 1, wherein said associated controller includes a window discriminator and a timer.

8. An apparatus for achieving cathodic protection against corrosion for a surface of a metallic aluminum-containing substrate, which is flushed by an electrolyte, the apparatus comprising:

a reference electrode;

a counter electrode;

means for flushing said reference electrode, said counter electrode and said substrate with the electrolyte;

electrolysis means connected to each of said reference electrode, said counter electrode and said substrate for performing an electrolysis between said substrate and said counter electrode;

means for selectively switching said electrolysis means on and off, said substrate having a surface which polarizes in response to said electrolysis being switched on;

means for measuring a control voltage corresponding to a difference between the electrochemical potential of said reference electrode and the electrochemical potential of said substrate when said electrolysis means is switched off, said reference electrode having an electrochemical potential which is independent of said electrolysis, said control voltage being independent of said counterelectrode; and regulation means for making a determination of a redox potential curve of the substrate when said electrolysis is switched off based on said measured control voltage and for effecting regulation of said electrolysis in response to said determination, said regulation means being set with a time interval for keeping said electrolysis switched off based on said redox potential curve having a desired slope such that said control voltage remains beneath a critical voltage potential for the time interval, said regulation means including means for switching on said electrolysis before said time interval passes in response to recognition that said redox potential curve is displaying a temporal change that exceeds the time interval for switching off said electrolysis such that said control voltage would exceed said critical voltage potential if said electrolysis is kept switched off for a full duration of the time interval.

9. An apparatus for achieving cathodic protection against corrosion for a surface of a metallic aluminum-containing substrate, which is flushed by an electrolyte, the apparatus comprising:

means for carrying out an electrolysis between a counterelectrode and the substrate to be protected until a first critical voltage is attained that is above a potential for uniform surface attack;

means for switching off said electrolysis in response to said first critical voltage having been attained, said first critical voltage being beneath a pitting potential;

means for measuring a control voltage corresponding to a difference between electrochemical potentials of a reference electrode and the substrate to be protected while said electrolysis is switched off;

means for switching on said electrolysis in response to said measured control voltage reaching a second critical voltage after an elapse of a set time interval having a duration sufficient for preventing said measured control voltage from exceeding said first critical voltage when said control voltage has a redox potential curve with an expected slope; and means for switching on said electrolysis in response to said control voltage exhibiting a temporal change that exceeds a set time interval for switching off said electrolysis so as to prevent said measured control voltage from exceeding said second critical voltage as would arise if said electrolysis switched off for an entire duration of said set time interval.

10. A method of achieving cathodic protection against corrosion for a surface of a metallic aluminum-containing substrate, which is flushed by an electrolyte, the method comprising the steps of:

carrying out an electrolysis between a counterelectrode and the substrate to be protected until a first critical voltage is attained that is above a potential for uniform surface attack;

switching off said electrolysis in response to said first critical voltage having been attained, said first critical voltage being beneath a pitting potential;

measuring a control voltage corresponding to a difference between the electrochemical potential of a reference electrode and the electrochemical potential of the substrate to be protected during the time that said electrolysis is switched off;

switching said electrolysis on in response to detection of said measured control voltage reaching a second critical voltage after an elapse of a set time interval, said time interval having a duration sufficient for preventing said measured control voltage from exceeding said first critical voltage when said control voltage has a redox potential curve with an expected slope; and switching on said electrolysis in response to said control voltage exhibiting a certain temporal change that exceeds a set time interval for switching off said electrolysis so as to prevent said measured control voltage from exceeding said second critical voltage as would arise if said electrolysis is kept switched off for the entire duration of said set time interval.

* * * * *